US006581413B1

(12) United States Patent
Kadosh

(10) Patent No.: US 6,581,413 B1
(45) Date of Patent: Jun. 24, 2003

(54) SYSTEM OF INTERCONNECTED ORNAMENTAL RINGS

(76) Inventor: Yoav Kadosh, 52 Kaplan St., Nahariya (IL), 22424

( * ) Notice: Subject to any disclaimer, the term of this patent is extended or adjusted under 35 U.S.C. 154(b) by 0 days.

(21) Appl. No.: 09/689,767

(22) Filed: Oct. 13, 2000

Related U.S. Application Data

(60) Provisional application No. 60/159,540, filed on Oct. 15, 1999.

(51) Int. Cl.[7] ..... A44C 19/00
(52) U.S. Cl. ..... 63/15.1; 63/1.11; 63/15
(58) Field of Search ..... 63/1.11, 15, 15.1, 63/15.2, 15.3

(56) References Cited

U.S. PATENT DOCUMENTS

| | | | | | |
|---|---|---|---|---|---|
| D67,909 | S | * | 7/1925 | Staub | D11/2 |
| 1,628,278 | A | * | 5/1927 | Scheuer | 63/3.1 |
| 1,691,445 | A | * | 11/1928 | Meliodon | 63/1.18 |
| D145,318 | S | * | 7/1946 | Lowenst | D11/2 |
| D203,551 | S | * | 1/1966 | Tranfield | D11/26 |
| 3,307,374 | A | * | 3/1967 | Kirshbaum | 63/1.11 |
| 4,932,396 | A | * | 6/1990 | Garris | 602/22 |
| 5,987,919 | A | * | 11/1999 | Hooser | 63/15 |

FOREIGN PATENT DOCUMENTS

| | | | | |
|---|---|---|---|---|
| GB | 804 | * | 1/1903 | 63/15 |
| GB | 340214 | * | 1/1903 | 63/15 |
| GB | 28346 | * | 5/1903 | 63/15 |

* cited by examiner

*Primary Examiner*—J. J. Swann
*Assistant Examiner*—Andrea Chop
(74) *Attorney, Agent, or Firm*—Edward Langer; Shiboleth, Yisraeli, Rober, Zisman & Co.

(57) ABSTRACT

A system of interconnected ornamental rings which convey a definite and clear message regarding the existence of an interpersonal relationship which, when worn by an individual, cannot be mistaken in the culture. In a preferred embodiment, the inventive system of interconnected ornamental rings comprises a pair of separate finger rings, each having a connection point at which there is attached a decorative chain interconnecting the separate rings. The system of interconnected rings can be worn on two fingers of the hand, with a finger in-between them, so that the decorative chain is prominently displayed. The message conveyed by such a pair of interconnected ornamental rings is very clear, indicating an interpersonal relationship with another, with the decorative chain which enhances the message with its particular type of decorative style. The system of interconnected ornamental rings provides several functions, including an indication function acceptable in the culture, by indicating an existing interpersonal relationship. It will be clear to all who notice the inventive jewelry ornament that the wearer has an existing interpersonal relationship. The system of ornamental rings provides a way of representing the object of the wearer's affections, and these may even be toward a favorite pet.

9 Claims, 2 Drawing Sheets

SYSTEM OF INTERCONNECTED ORNAMENTAL RINGS

This application claims benefit of Provisional Application No. 60/159,540 filed Oct. 13, 1999.

FIELD OF THE INVENTION

The present invention relates to ornamental jewelry and the like, and more particularly, to a system of interconnected ornamental rings for wearing on the fingers or toes, which can indicate a interpersonal relationship with another.

BACKGROUND OF THE INVENTION

The wearing of marital engagement rings, wedding bands, and other ornamental jewelry is a long and cherished custom among many different cultures, to signify a love relationship or bond between individuals. Jewelry items are significant in conveying messages within the culture, and are worn for this purpose. In particular, an engagement ring indicates to all observers that the individual wearing the ring is betrothed, or promised to be married to another, and this carries an important message for any potential advances which may be of an interpersonal nature, or attempts to develop a relationship beyond that acceptable in casual discourse.

The individual engagement ring, traditionally worn on the finger of the hand adjacent the little finger, commonly referred to as the ring finger, may be a diamond ring, and of course the costs associated with such an expensive piece of jewelry may make it inaccessible to all but the most seriously inclined. However, the desire to express a bond or particularly meaningful relationship with another person should not be thwarted by the costs involved, so that there are other expressions in the form of jewelry pins, a broach, a wristwatch or necklace, wrist band or other such ornament, to indicate the existence of such relationships. Generally, the meaning of these ornaments is not immediately apparent to observers, and sometimes this creates unpleasant situations where unwanted advances are made to a female wearer of such ornaments, for example, without the intention to be rude or overt.

Therefore, there is a need for the wearer of a jewelry ornament signifying a particular interpersonal relationship with another person, to convey a message by virtue of the wearing of such ornament, with the message being clear and obvious.

SUMMARY OF THE INVENTION

Accordingly, it is a principal object of the present invention to overcome the problems of prior art ornaments in conveying cultural messages regarding interpersonal relationships, and provide a system of interconnected ornamental rings, to be worn on the ring and index fingers of the left hand, which convey a definite and clear message regarding the existence of an interpersonal relationship which, when worn by an individual, cannot be mistaken in the culture.

In accordance with a preferred embodiment of the present invention, there is provided a system of interconnected ornamental rings for signifying an interpersonal relationship, said system comprising:

a pair of separate rings;

connection means interconnecting said separate rings.

In a preferred embodiment, the inventive system of interconnected ornamental rings comprises a pair of separate finger rings, each having a connection point at which there is attached a decorative chain interconnecting the separate rings. The system of interconnected rings is to be worn on the ring and index fingers of the left hand, with the middle finger in between them, so that the decorative chains are prominently displayed. The point at which the two chains join together visibly represents the bond between two people, symbolizing the point at which they become one.

The message conveyed by such a pair of interconnected ornamental rings is very clear, indicating an interpersonal relationship with another, signified by the second ring, and its direct and permanent connection with the first ring. The decorative chain enhances the message with its particular type of decorative style.

The system of interconnected ornamental rings provides several functions, including an indication function acceptable in the culture, by indicating an existing interpersonal relationship with another.

When the wearer of the system of interconnected ornamental rings comes in contact with others in any social context, in the workplace, while traveling on public transportation, while shopping, while dining in restaurants or frequenting bars, it will be clear to all who notice the inventive jewelry ornament that the wearer has an existing interpersonal relationship with another.

Thus, the inventive system serves the very important function of promoting smooth interpersonal conduct between individuals, and might minimize social function, possibly reducing undesirable conduct in the society as a whole.

The system of ornamental rings uses the second ring to provide a way of representing the object of the wearer's affections, even toward a favorite pet.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
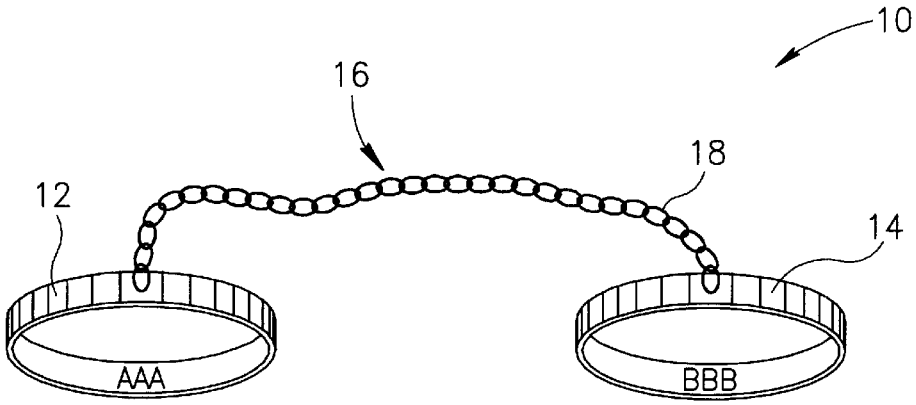
FIG. 1 is a perspective view of a system of interconnected ornamental rings constructed in accordance with the principles of the present invention.
Figure 2:
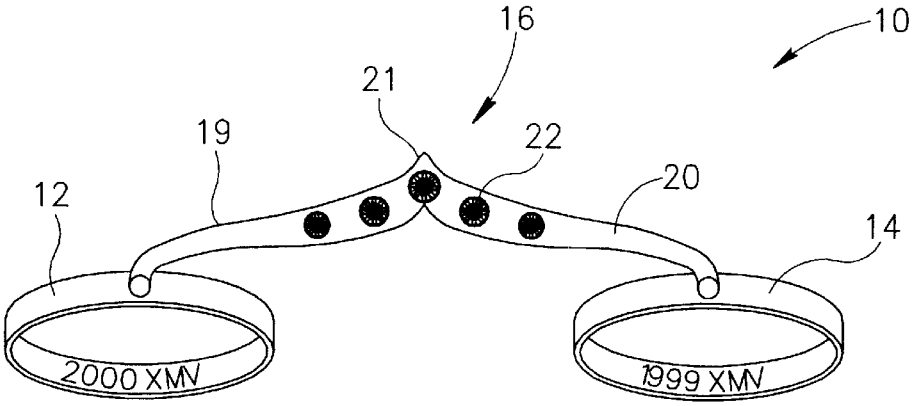
FIG. 2 is an alternative embodiment of the system of FIG. 1.
Figure 3:
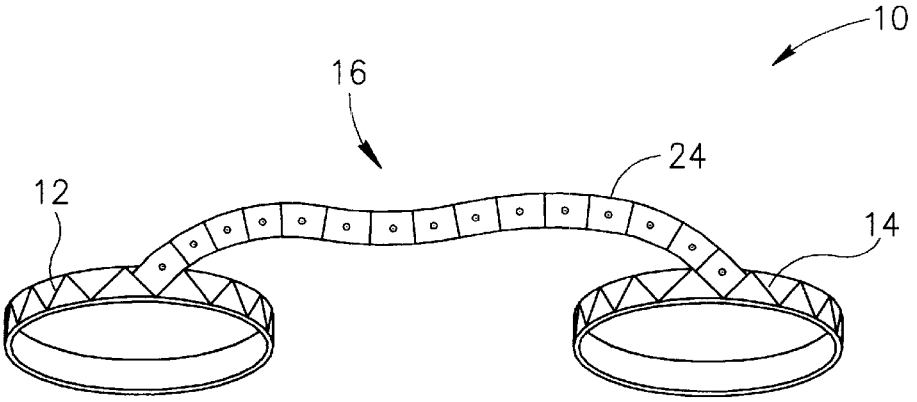
FIG. 3 is another alternative embodiment of the system of FIG. 1.

Referring now to FIGS. 1–3, there is shown a perspective view of a system 10 comprising a pair of interconnected ornamental rings 12, 14 constructed in accordance with the principles of the present invention. Each pair of rings 12, 14 had a decorative appearance which may be supplied by an engraved design of the ring's surface. The designs may be similar for each of the pair of rings 12, 14 or they may be different. The pair of interconnected ornamental rings 12, 14 is generally worn on the ring and index fingers of the left hand to indicate the existence of an interpersonal relationship with the wearer of the ring.

In addition to the engraved design, the pair of rings 12, 14 may be engraved with information related to the wearer (represented by engraving "AAA") and the one with whom an interpersonal relationship exists (represented by engraving "BBB"). Examples of the engraved information may include the name of a loved one, wife or husband, fiancee, birthday, birth sign, names of children, etc. The design of the ring may also include information as to the uniqueness of the design, for example, by incorporation of a continuous serial number of the ring's production, making the ring more valuable as an numbered copy of a limited production issue.

The ornamental rings 12, 14 are interconnected by a link 16, which may be provided in alternative embodiments as a chain, or segmented links, with its ends attached to each of rings 12, 14, and its length extending loosely between them. The decorative design of the link 16 is open to very many variations, all serving the common purpose of linking the rings 12, 14 together in an attractive design.

The link 16 may be engraved with information related to the wearer and the one with whom an interpersonal relationship exists, as described above with respect to the rings. The method of attaching the link 16 to the ornamental rings 12, 14 may be any acceptable manufacturing method in the jewelry design arts, including soldering, mechanical clamping to a hinge formed on the rings, or fastening by use of a pin and socket. Other methods allowing for the link 16 to extend loosely are acceptable.

The significance of the linkage between the rings, as explained in the Summary, is that it indicates an interpersonal relationship with another, signified by the second ring, and its direct and permanent connection with the first ring. The decorative chain 16 enhances the message with its particular type of decorative style.

The message conveyed by the rings in the social context, and the ability to smooth interpersonal contact, while possibly reducing undesirable conduct, makes the inventive system of interconnected ornamental rings a useful jewelry item.

In FIG. 1, the link is shown as a chain of interconnected individual links 18.

In FIG. 2, the link 16 is shown as a pair of links 19, 20 connected at their ends so as to form a point 21, each link 19, 20 having a plurality of precious stones 22 mounted in them. Point 21 at which the two links join together visibly represents the bond between two people, symbolizing the point at which they become one.

In FIG. 3, segmented chain 24 is formed to provide the link 16.

Figure 4:
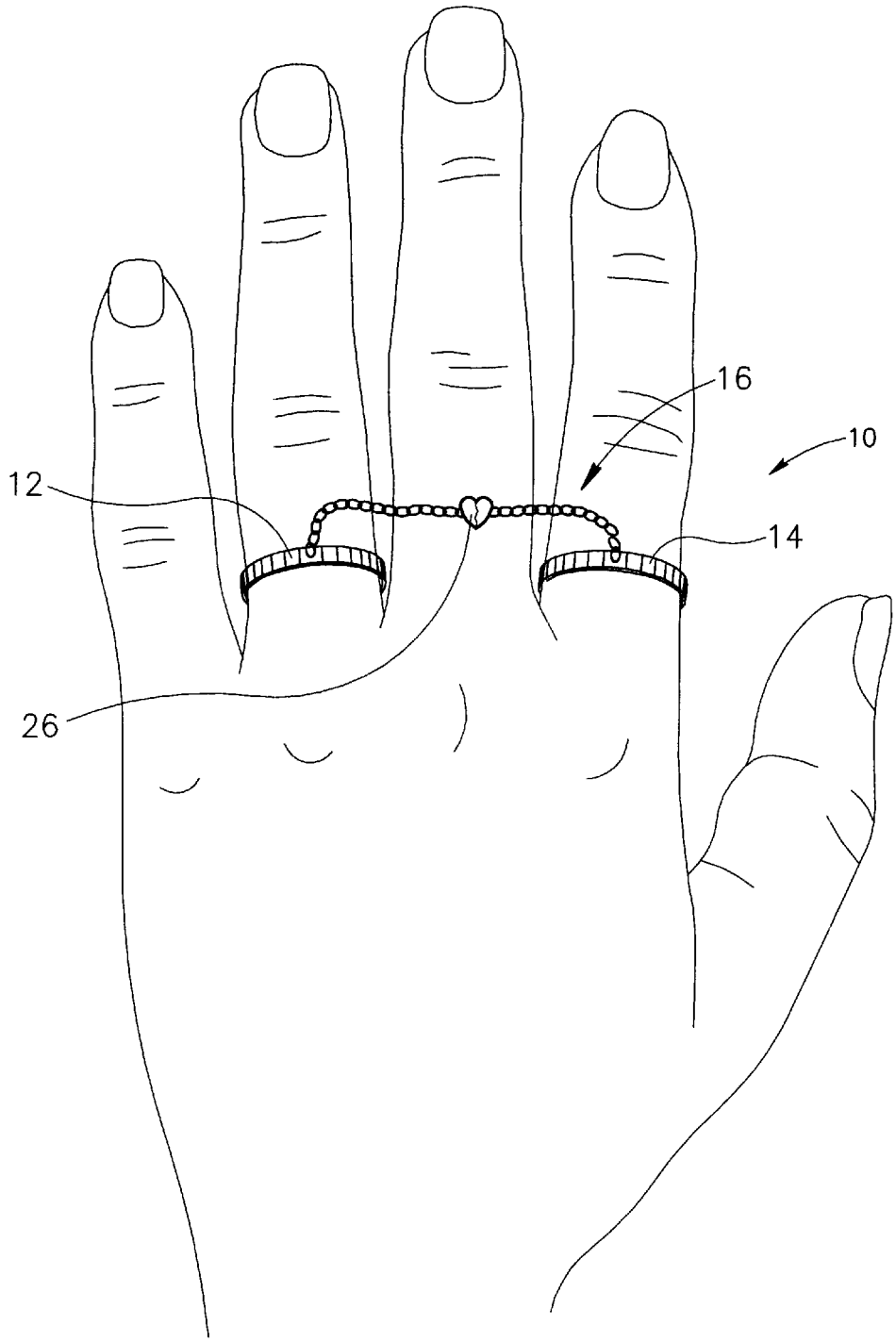
FIG. 4 is a top view of still another alternative embodiment of the system of FIG. 1, worn on the two fingers of the hand of a wearer.

Referring now to FIG. 4, there is shown a top view of still another alternative embodiment of the system of FIG. 1, worn on the ring and index fingers of the left hand of a wearer, with the middle finger as an intermediate finger over which the link 16 extends loosely. In this embodiment, the link 16 is provided as a chain joined at its midsection by an item of jewelry, such as a heart-shaped jewelry charm 26. In this design, the message conveyed is that of a bond between people, which is signified by the interconnected rings 12, 14 and this is reinforced by the jewelry charm 26, which symbolizes love.

It will be understood that the inventive system of interconnected ornamental rings can also be worn on two toes of the foot, with an in-between intermediate toe.

Many variations of the particular aesthetic design of the inventive system of interconnected ornamental rings may be contemplated, all serving the basic function of conveying a message of the existence of an interpersonal relationship between the wearer of the ornamental rings and another individual, or even with a favorite pet.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

What is claimed is:

1. A system of interconnected ornamental rings for signifying an interpersonal relationship, said system comprising:

a pair of separate rings; and two link structures interconnecting said separate rings, wherein a first of said pair of separate rings is adapted to be worn on the index finger of the left hand, and a second of said pair of separate rings is adapted to be worn on the ring finger of the left hand, spaced apart by the middle finger, and said link structures extend between said pair of separate rings and are adapted to extend over said middle finger, and wherein said two interconnecting link structures meet at a singular point which visibly represents the bond between two people, symbolizing the point at which they become one.

2. The system of claim 1 wherein said link structures have a decorative style.

3. The system of claim 1 wherein said link structures comprise a chain of links.

4. The system of claim 1 wherein said link structures comprise a segmented chain.

5. The system of claim 1 wherein said link structures comprise a pair of interconnected links.

6. The system of claim 1 wherein said link structures include thereon a plurality of embedded precious stones.

7. The system of claim 1 wherein said rings are engraved with information.

8. The system of claim 1 wherein said link structures are engraved with information.

9. A method for signifying an interpersonal relationship, comprising the steps of:

providing a pair of separate rings and two link structures interconnecting said separate rings, said interconnecting link structures being joined at a distinct point;

positioning a first of said pair of separate rings on the index finger of the left hand; and positioning a second of said pair of separate rings on the ring finger of the left hand, such that said separate rings are spaced apart by the middle finger, and said link structures extend between said pair of separate rings over said middle finger, wherein said distinct point joining said interconnecting link structures represents the bond between two people, symbolizing the point at which they become one.

* * * * *